United States Patent [19]

Murai

[11] 4,325,041

[45] Apr. 13, 1982

[54] CIRCUIT INTERRUPTER

[75] Inventor: Wasaburo Murai, Osaka, Japan

[73] Assignee: Terasaki Denki Sangyo Kabushiki Kaisha, Osaka, Japan

[21] Appl. No.: 206,857

[22] Filed: Nov. 6, 1980

[30] Foreign Application Priority Data

Nov. 10, 1979 [JP] Japan ..... 54-144939

[51] Int. Cl.[3] ..... H01H 75/00; H01H 77/00; H01H 83/00

[52] U.S. Cl. ..... 335/35; 335/16; 335/201

[58] Field of Search ..... 335/16, 195, 147, 35, 335/23, 174, 201, 23, 173

[56] References Cited

U.S. PATENT DOCUMENTS

| | | | |
|---|---|---|---|
| 3,104,297 | 9/1963 | Powell et al. | 335/16 |
| 3,815,059 | 6/1974 | Spoelman | 335/16 |
| 3,943,316 | 3/1976 | Oster | 200/336 |
| 3,943,472 | 3/1976 | Oster et al. | 335/16 |
| 3,943,473 | 3/1976 | Khalid | 335/16 |
| 3,944,953 | 3/1976 | Oster | 335/23 |
| 3,946,346 | 3/1976 | Oster et al. | 335/16 |
| 3,956,723 | 5/1976 | Dickens et al. | 335/201 |
| 4,090,156 | 5/1978 | Gryctko | 335/35 |

FOREIGN PATENT DOCUMENTS

| | | |
|---|---|---|
| 50-149980 | 12/1975 | Japan . |
| 53-45256 | 10/1978 | Japan . |

*Primary Examiner*—Harold Broome

*Attorney, Agent, or Firm*—Wenderoth, Lind & Ponack

[57] ABSTRACT

The disclosed circuit interrupter comprises a magnetic core structure including a magnetic core and magnetic yokes defining an annular magnetic gap around the core, and a primary and a secondary coil wound on the core to form a current transformer. The movable contact arm is disposed in the magnetic gap to be magnetically driven to the open position, and a magnetic armature of an instantaneous trip means is disposed adjacent to the magnetic yokes so that it is magnetically actuated upon a short-circuit current. A bimetallic element of a thermally responsive trip means is electrically connected to the secondary coil of the transformer. The magnetic yokes include extended portions which serve as magnetic means for driving an electric arc established between the separated contacts into an arc extinguisher which is also disposed between the magnetic yokes.

3 Claims, 15 Drawing Figures

CIRCUIT INTERRUPTER

FIELD OF THE INVENTION

This invention relates to circuit interrupters, and more particularly to circuit interrupters having an electromagnetic device including a current transformer means, an electromagnetic drive means for separating a movable contact arm from a stationary contact, an arc drive means for driving an arc into an arc extinguisher, and an instantaneous trip means.

DESCRIPTION OF THE PRIOR ART

Recent requirements for low voltage circuit breakers, particularly wiring circuit breakers, include the protection functions listed below:

1. The function of protecting a circuit from overcurrents and short-circuit currents.
2. The function of protecting a motor starter used for start up and shut down, and overload protection of an electric motor against short-circuit currents.
3. The function of start up and shut down and overload protection for an electric motor as well as short-circuit protection.

The first above function is the one which has been commonly required in wiring circuit breakers. However, short-circuit currents have recently increased to the order of 50,000 A at 460 V AC, while on the other hand this first function is also required in small circuit breakers such as a breaker for a rated current of about 50 A. Circuit breakers are required not only to have the interrupting function by itself, but also to be able to limit a short circuit current and complete the interruption so that thin electrical conductors used in small rated current circuit breakers are not overheated and broken.

In a wiring circuit breaker with the above function, a so-called current limiting breaker is used which has a current limiting function limiting the electrical wire temperature increase to about 150° C. for the maximum short-circuit current in a circuit with electrical conductors coated with vinyl chloride and having a minimum cross sectional area of 2 $mm^2$. The current limiting ability of the current limiting breaker is expressed by the Joule integrated value obtained by raising the instantaneous current value during the short circuit to the second power and integrating it with respect to the total interrupting time (hereinafter referred to as total interruption $I^2t$). However, the Joule integrated value permitted to flow through the above electrical conductor of 2 $mm^2$ cross section without causing overheating (hereinafter referred to as allowable $I^2t$) is $5\times10^4$ $A^2$ sec.

In order for the wiring circuit breaker to satisfy the above second function, the breaker must feed fill the following three requirements:

The first requirement is to have the function of protecting a motor starter which typically includes an electromagnetic contactor and a thermally responsive overload relay against damage upon a short-circuit fault. In such a fault also, the short circuit current within the circuit can often reach as high as 50,000 A and the total 2 interruption $I^2t$ of the wiring breaker tends to increase, whereas the allowable $I^2t$ of the motor starter against short circuiting is low, and particularly the allowable $I^2t$ of the thermally responsive overload relay is low. For example, a thermally responsive overload relay of a 1 A rated current has an allowable $I^2t$ of the order of about $8\times10^2$ $A^2$ sec. The total interruption $I^2t$ of the wiring interrupter for the short-circuit protection of the starter should be still smaller than that in the previously discussed electric wire protection. Taking the above into consideration, IEC Publication 292-1, Direct-On-Line (Full Voltage) AC Starters—Appendix C, Co-ordination with Short-Circuit Protective Device classifies the protective devices into the following three protective types:

Type A: The device may be destroyed upon short circuiting but must be repairable by replacement.

Type B: Characteristics of thermally responsive overload relay may deviate. Also, slight welding of the electromagnetic contactor is sometimes permitted.

Type C: No damage is permitted. However, slight welding of the electromagnetic contactor is sometimes permitted.

The current limiting fuse typically has a very small total interruption $I^2t$, and when this fuse is used as the short circuit protective device for a motor starter the above Type C requirement is satisfied.

However, since the current limiting fuse requires time consuming replacement after its break down and may cause an open phase, the wiring breaker is more popular than the current limiting fuse. With the wiring breaker, even when a current limiting function is provided by a usual contact arm structure utilizing an electromagnetic repulsive force, the above Type C requirement can not be satisfied when the overall load capacity of the motor starter is as small as about 10 A or less. Therefore, according to the prior art, the requirement for Type C protection of a small-sized motor starter thas been satisfied by the serial insertion of a current limiting resistor of several ten milli-ohms with a wiring breaker of the oil dashpot trip type to increase the rated interrupting capacity of the circuit breaker and the internal impedance within the circuit breaker itself. However, since as the rated current of the circuit breaker increases the temperature of the resistor increases, it is difficult to provide a breaker of a rated current of 12 A or more.

The second requirement for achieving the second function of the wiring breaker, i.e., the short circuit protection of a motor starter, is that the instantaneous tripping of the wiring breaker should not be actuated by a normal motor start up current and should be immediately actuated upon the occurrence of a fault current exceeding the normal start up current. The typical thermally responsive, electromagentic tripping, wiring breaker has a minimum rated current of 15 A as prescribed by Japanese Industrial Standard C-8370, and the actual lower limit that can be manufactured is 10 A. The instantaneous value for the above is about ten times the rated current. In this case, when a wiring breaker having an instantaneous tripping current value of 100 A and a rated current of 10 A is used as a short-circuit protective device for a motor starter with a total load current of 1 A, since the thermally responsive overload relay normally guarantees an allowable magnitude of the overload current of about 10 to 15 times, an overcurrent exceeding the allowable overload current is not enough to instantaneously trip the wiring breaker, resulting in the melting and burning out of the thermally responsive overload relay during the short-circuiting. Therefore, the instantaneous tripping value is preferably within the range of from 12 to 15 times the total loadcurrent of the motor starter. In the wiring breaker of the thermally responsive electromagnetic trip type, it is desirable to provide a wiring breaker having a low rated current and an instantaneous trip current which is greater than the rated current by a predetermined desirable factor which satisfies the above mentioned desirable conditions.

The third requirement is the ability of the short circuit protective device to be arranged in a centralized control panel. Combinations of the motor starter and the short circuit protective device are used one for each such combination is arranged in a relatively small housing unit and these units are stacked in the centralized control panel.

Under these circumstances, the housing unit is designed to be as compact as possible, and it is difficult to provide sufficient heat dissipating space. Therefore the heat generation within the housing should be limited to be as low as possible. It is not preferable to use a circuit breaker with a serially inserted current limiting resistor, and it is necessary to design the wiring breaker generating only a small quantity of heat. It is further desirable to incorporate the function of the thermally responsive overload relay, which generates massive heat, into the wiring breaker, thereby removing the thermally responsive overload relay from the breaker. In this case, since the wiring breaker must have the function of overload protection of an electric motor, the breaker can be classified as one with the above mentioned third protective function of the wiring breaker.

In order to satisfy the above mentioned third function of the wiring breaker, the following two requirements must be satisfied:

The first requirement is that the overload trip current setting of the wiring breaker be adjustable within a certain range so that the set value of the overload trip current is adapted to the varying total load current differing in accordance with the capacity, rated voltage, frequency used, number of poles, protective system and the manufacturer of the electric motor, and that the coordination be maintained so that the wiring breaker protects the electric motor from burning cut against any overload. To make the setting of the overload trip current adjustable, a bimetallic trip type is easier and superior in practical use as compared to the dashpot trip type. The setting of the overload trip current of this wiring breaker must be very low, such as a practical minimum value of about 1 A, in order to protect a small sized electric motor. The conventional dashpot type electromagnetic wiring breaker can be set to have a small overload trip current, but it is difficult to arrange the trip current to be adjustable, whereas in the conventional bimetallic trip type, which is easily made adjustable with respect to the trip current it is difficult to obtain a small overload trip current such as 1 A, presenting a considerable obstacle which must be overcome.

The second requirement, which is related to the previously discussed second requirement for obtaining the second function of the wiring breaker, is the ability to instantaneously trip within the range of from 12 times to 15 times the set value of the overload tripping of the wiring breaker, because it is desirable that the wiring breaker not be tripped by the start up current of the electric motor but be tripped as quickly as possible by a fault current exceeding the start up current. If the instantaneous tripping is effected at a value of several ten times the overload trip set value, the damage to the electric motor will be increased.

SUMMARY OF THE INVENTION

Accordingly, an object of the present invention is to provide a circuit interrupter which can be manufactured to have a maximum rated current as high as about 200 A and which is high in rated interruption current and improved in current limiting capability.

Another object of the present invention is to provide a circuit interrupter which provides a Type C protection capability according to the IEC standard with respect to any small sized motor starter having a practical minimum value of about 1 A for the total load current.

Still another object of the present invention is to provide a circuit interrupter which comprises an electromagnetic device for electromagnetically driving a movable contact arm for achieving the first and second above objects, the electromagnetic device being formed of a plurality of turns of conductors, being small in total interruption $I^2t$ below the rated interruption current, and being constant in ampere turns with respect to the different rated currents, thereby compensating for the electromagnetic driving force even when the rated current is small, to provide a total interruption $I^2t$ which decreases with the decrease in the rated current.

Still another object of the present invention is to provide a circuit interrupter which is capable of being manufactured into the bimetallic trip type with a small rated current of a practical minimum value as low as about 1 A, and which does not require a high bimetallic resistance as has heretofore been the case even with a small rated current, and which enables the varying main circuit current to produce a constant secondary current with a current transformer of an electromagnetic device according to the present invention.

Still another object of the present invention is to provide a circuit interrupter wherein an electromagnetic device including a current transformer limits the secondary current by the magnetic saturation phenomenon at the time of a short circuit, thereby preventing an overcurrent trip element from being overheated and damaged by a current up to a high rated interruption current, even for a circuit interrupter of small rated current.

Still another object of the invention is to provide a circuit interrupter having an instantaneous trip means which is operated at a substantially constant magnitude of the instantaneous trip set current value even when the rated current is very small and irrespective of the magnitude of the circuit interrupter rated current or the total load current of the motor starter, to function as a motor starter protective interrupter or a motor protective interrupter.

Still another object of the present invention is to provide a circuit interrupter wherein the short-circuit current limiting function is obtained without using a current limiting resistor, and the circuit interrupter generates a small amount of heat with a current below the rated current and upon the occurrence of a short circuit current generates a massive electromagnetic force on a movable contact arm to rapidly increase arc resistance to achieve the current limiting function to provide a relatively small total interruption $I^2t$.

Still another object of the present invention is to provide a circuit interrupter of the bimetal trip type in which the adjustment of the overload trip current setting is relatively easy and which can be manufactured to have a high interruption performance in spite of a very small rated current.

Still another object of the present invention is to provide a circuit interrupter wherein an electromagnetic device is used to provide multi-functions thereby providing a compact and inexpensive interrupter with high performance and multi purposes.

With the above objects in view, a circuit interrupter of the present invention comprises in an insulating housing a mangetic core means including a magnetic core and at least two separate magnetic yokes magnetically coupled to the magnetic core to define a magnetic gap between the magnetic yokes. A current transformer having a primary coil and a secondary coil is wound around the magnetic core of the magnetic core means, and a pair of separable contacts is serially connected to the primary coil of the transformer. The series connected primary coil and the contacts are connectable to an external circuit to be protected by the interrupter. At least one of the separable contacts is carried by a movable contact arm disposed within the magnetic gap defined in the magnetic core means and is capable of being magnetically driven into an open position by an electromagnetic force generated between the magnetic core means and the movable contact arm. The circuit interrupter also comprises an operating mechanism for opening and closing the separable contacts, a thermally responsive trip means including a bimetal element serially connected to the secondary coil of the current transformer and actuating the operating mechanism to open the separable contacts upon the occurrence of an overcurrent, and an instantaneous trip means including a magnetic armature disposed in the vicinity of the magnetic core means so as to be electromagnetically actuated by the magnetic core means to magnetically actuate the operating mechanism to open the contacts upon the occurrence of a short-circuit current. The interrupter further comprises an arc extinguishing means disposed within the magnetic gap of the magnetic core means for splitting, cooling and extinguishing an electric arc, and arc driving means including portions of the magnetic yokes of the magnetic core means in the vicinity of the arcing region for magnetically driving an electric arc established between separated contacts into the arc extinguishing means for arc extinction.

Preferably, the magnetic yokes of the magnetic core means are two parallel magnetic plates magnetically coupled to the opposite ends of the magnetic core, while the magnetic gap defined therebetween is substantially annular surrounding the magnetic core, and the primary and the secondary coils are disposed in the annular magnetic gap with the contacts, the contact arm and the arc extinguishing means being disposed directly outside of the primary and the secondary coils and within the magnetic gap between the magnetic yokes.

BRIEF DESCRIPTION OF THE DRAWINGS

The present invention will now be described for the preferred embodiment thereof in conjunction with the accompanying drawings, in which.

DESCRIPTION OF THE PREFERRED EMBODIMENT

Figure 1:
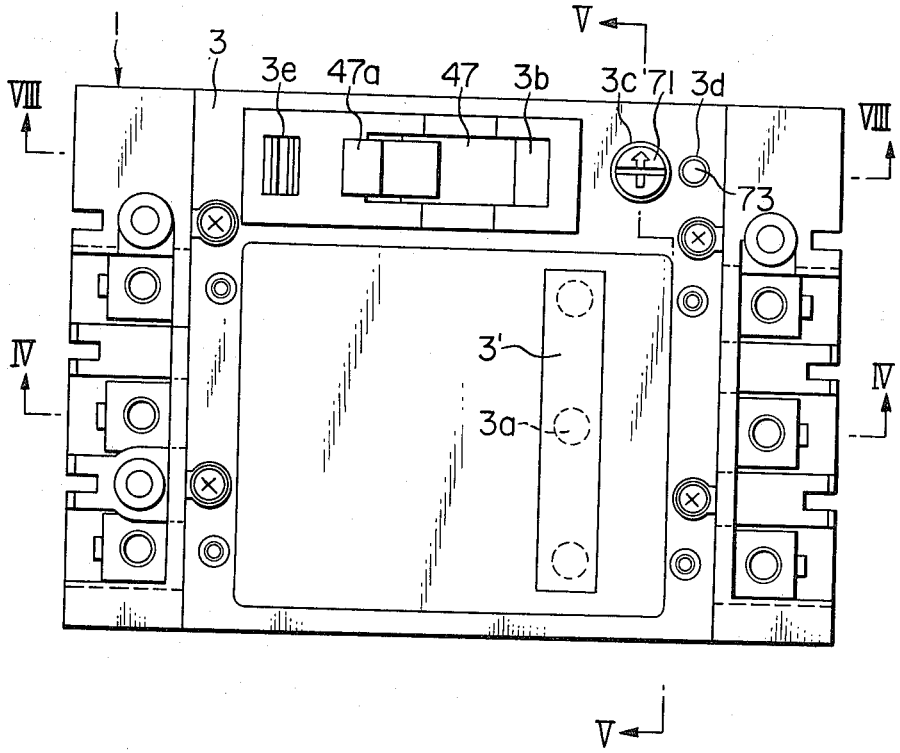
FIG. 1 is a plan view of a circuit interrupter constructed in accordance with the present invention.
Figure 2:
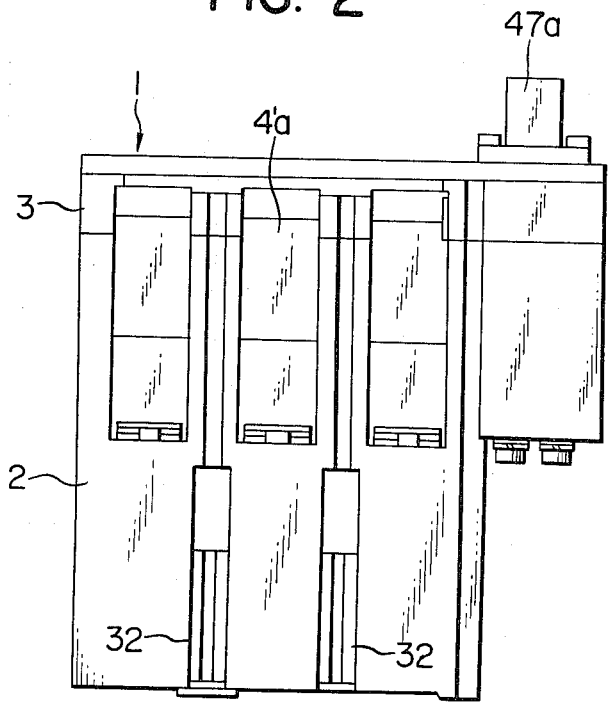
FIG. 2 is a right side view of the circuit interrupter shown in FIG. 1.
Figure 3:
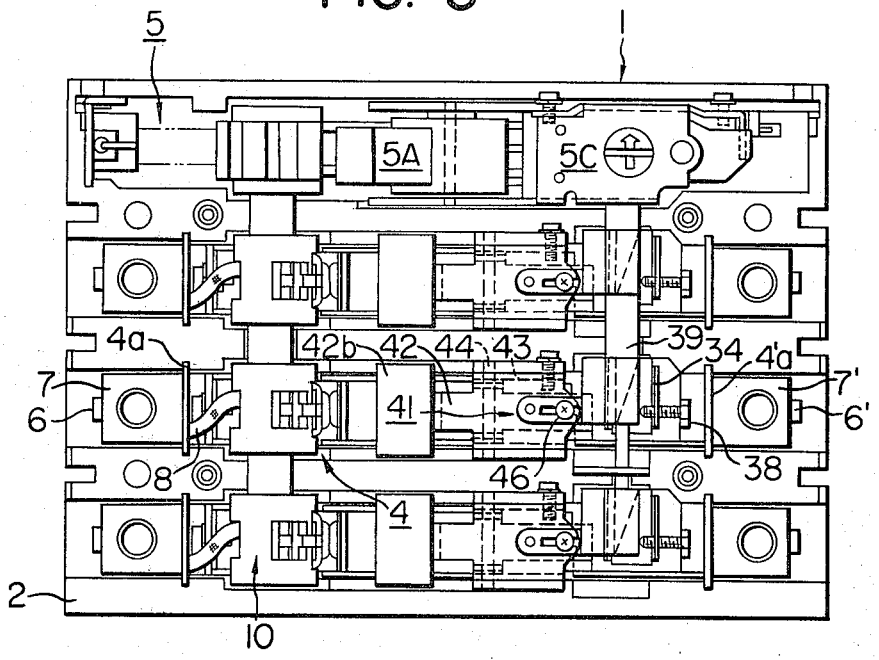
FIG. 3 is a plan view of the circuit interrupter shown in FIG. 1 with its molded cover removed.

Referring to FIGS. 1 to 3 of the drawing, a circuit interrupter of the present invention comprises a molded insulating housing 1 composed of a base 2 including a base cover 2' (FIG. 4) and a cover 3. The housing 1 defines therein a plurality of pole compartments 4 partitioned by insulating walls for enclosing therein main components of the pole units and an operating mechanism compartment 5 disposed along one of the pole compartments 4 for housing therein an operating mechanism 5A, a trip mechanism 5B and a rated current adjustment mechanism 5C.

Figure 4:
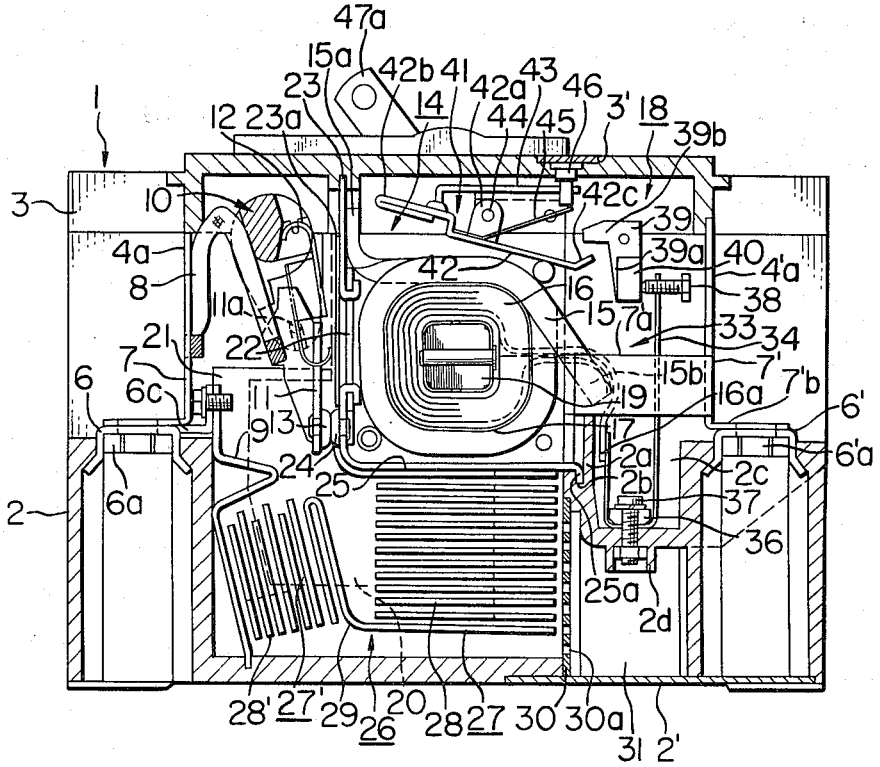
FIG. 4 is a sectional view taken along the line IV—IV of FIG. 1.

As best shown in FIG. 4, each of the pole units has terminals 6, 6' at its opposite ends for connection to an external circuit to be protected. The terminals 6, 6' have tapped terminal plates 6*a*, 6'*a* and are molded within the molded base 2 of the housing 1. Terminal conductor plates 7, 7' are connected to the terminals 6, 6' and constitute end walls for the pole compartment together with pole compartment end plates 4*a*, 4'*a*. One of the terminal conductor plates 7 is connected to one end of a flexible conductor 8, and the associated terminal 6 is connected to an arc horn 9 by means of a conductive piece 6*c* extending through the end wall of the molded base 2.

Figure 12A:
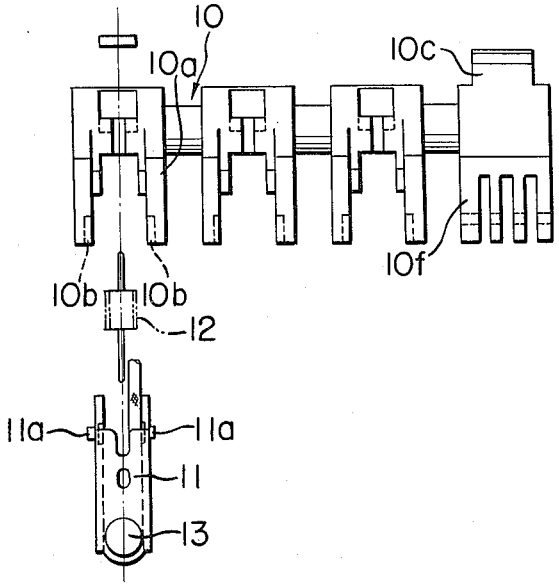
FIG. 12*a* is an exploded side view showing the contact cross bar and the movable contact.
Figure 12B:
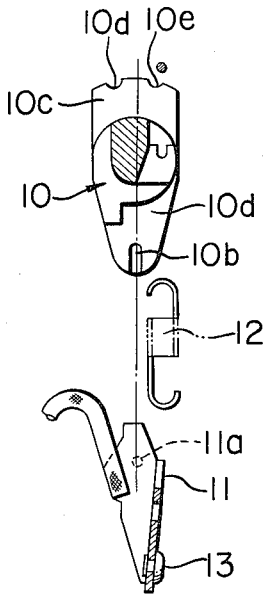
FIG. 12*b* is an exploded view of the contact cross bar and the movable contact.

A cross bar 10 made of a molded insulating material extends from the operating mechanism compartment 5 to each pole unit. The cross bar 10 includes, as seen from FIGS. 12*a* and 12*b*, a pair of contact holder members 10*a* for each pole, and the contact holder members 10*a* have formed therein grooves 10*b* in which projecting pins 11*a* of a substantially U-shaped movable contact arm 11 are pivotably received, whereby the movable contact arm 11 is pivotably mounted between the pair of contact holder members 10*a* of the cross bar 10. Between the cross bar 10 and the movable contact arm 11 is mounted a contact spring 12 for usually applying a contact pressure to the movable contact arm 11 in the counterclockwise direction. The movable contact arm 11 is connected to the flexible conductor 8 extending from the terminal 6 and its free end has a movable contact 13.

Figure 7:
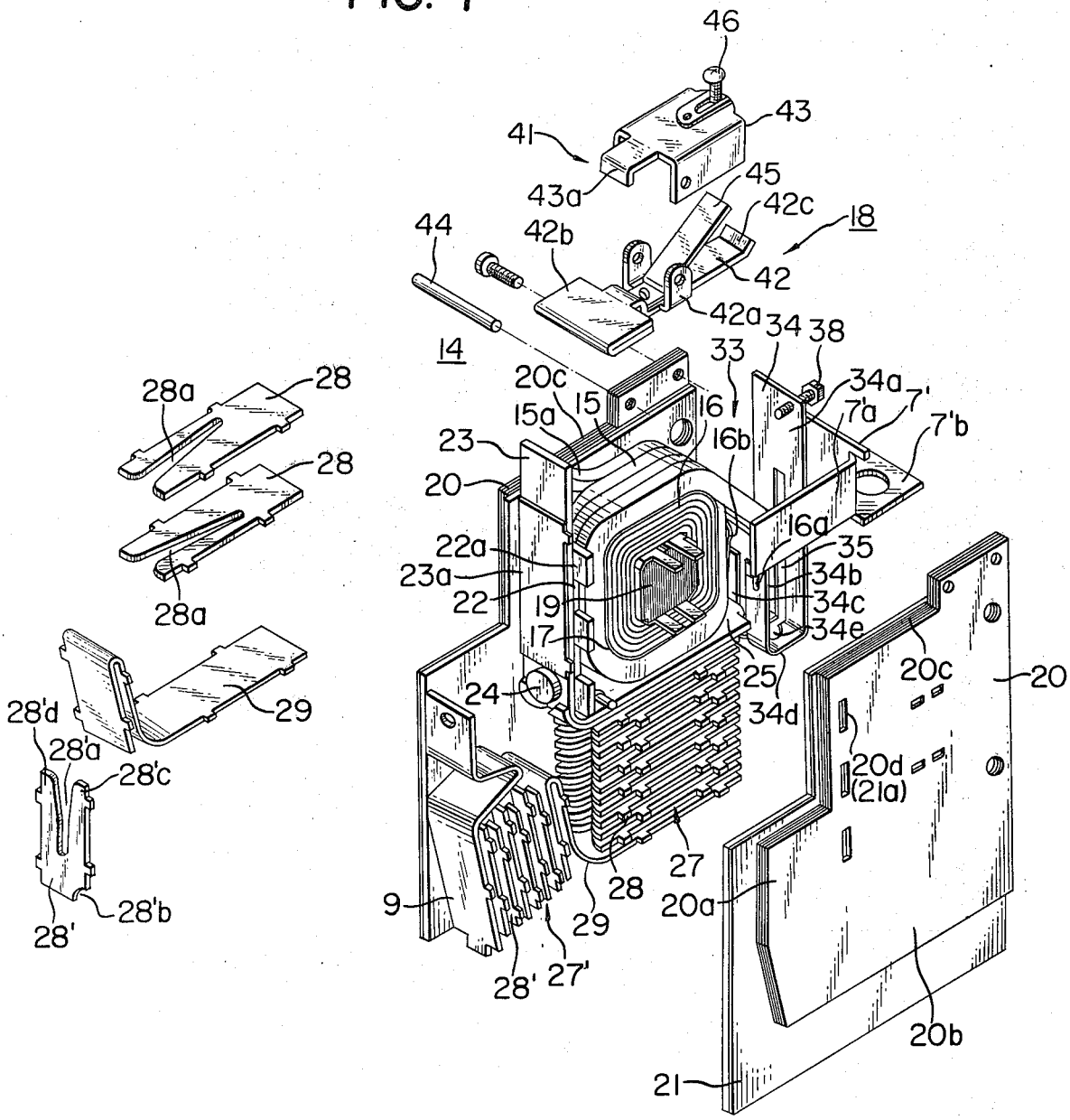
FIG. 7 is an exploded perspective view of the main component of the electromagnetic device of a circuit interrupter of the present invention.

An electromagnetic device 14 which constitutes the main component of the present invention is disposed in the central area of the interrupter together with its associated components. The electromagnetic device 14 comprises a primary coil 15 and a secondary coil 16. The primary coil 15 is formed of an insulated winding of which the cross section and number of turns are selected in accordance with the desired rated current so that the number of ampere turns is substantially the same with respect to the rated current irrespective of its magnitude. The secondary coil 16 is also formed of an insulated winding disposed inside of the primary coil 15 and insulated by insulation 17. The secondary coil 16 is connected through its lead conductors 16*a*, 16*b* to an overcurrent responsive means 18. The winding cross-section area and the number of turns can be made always the same irrespective of the rated current desired. A stationary magnetic core 19 made of a stack of silicon steel plates is electrically insulated from the secondary coil 16. Thus, the secondary coil 16 is wound around the magnetic core 19 and the primary coil 15 is wound around the secondary coil 16 in a coaxial relationship. At the opposite ends of the magnetic core 19 magnetic yokes 20 made of a plurality of laminations are attached to form a generally H-shaped magnetic core means. The yokes 20 are disposed at both sides of the primary and secondary coils 15, 16 to form a current transformer, and have portions thereof which extend beyond the outer periphery of the outer primary coil 15 to form a contact portion 20*a*, an arc extinguisher portion 20*b* and an instantaneous trip portion 20*c* (FIG. 7). A yoke insulating plate 21 is attached to the inner face of the magnetic yoke 20. The insulating plate 21 is larger than the magnetic yoke 20 and extends outwardly beyond the contact portion 20*a* and the arc extinguisher portion 20*b* of the magnetic yoke 20. A contact support base 22 is mounted between the magnetic yokes 20 by tubs 22*a* on the opposite sides of the contact base 22 inserted in slots 21*a*, 20*d* in the insulating plate 21 and the magnetic yoke 20. The contact support base 22 is made of an insulating plate and closes the space between the insulating plates 21 at the contact side of the magnetic yokes 20. A stationary contact arm 23 made of a generally L-shaped electrically conductive plate is supported by the contact base 22 and has a stationary contact 24 at the position corresponding to the movable contact 13. One end of the contact arm 23 is connected to a lead conductor 15*a* and the other end is connected to a stationary side arc horn 25 made of a metallic material. The stationary side arc horn 25 which may be formed integral with or separate from the stationary contact arm 23, extends immediately below the primary coil 15 until its end abuts against the end wall of the arc extinguisher compartment 26 where engagement tubs 25*a* are inserted and engaged with slots 2*b* formed in a partition wall 2*a* for a trip element containing section of the molded base 2. The stationary contact 23 has attached thereon an arc insulating plate 23*a*. The stationary side arc horn 25 also substantially completely partitions the space between the pair of yoke insulating plates 21 into the arc extinguisher compartment 26 and the space in which the primary and secondary coils 15, 16 are disposed. The overcurrent responsive mechanism 18 is isolated by the partition wall 2*a* of the molded base 2 from the arc extinguisher.

Figure 6:
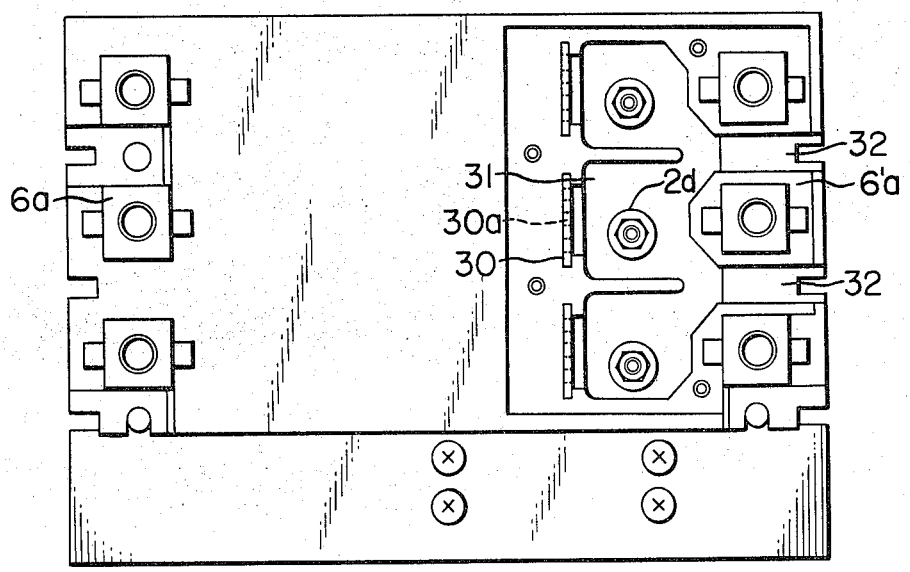
FIG. 6 is a bottom view of the circuit interrupter shown in FIG. 1 with its bottom partly removed.

Arc extinguishing grids 27, 27' are formed of a plurality of arc extinguishing plates 28, 28' housed within the arc extinguishing chamber 26. The arc extinguishing grid 27 is disposed below the stationary side arc horn 25 which extends horizontally below the primary coil 15, and the arc extinguishing grid 27' is located on the side of the arc horn 9 which is disposed in one end region of the arc extinguishing chamber 26 and extends toward the bottom wall of the molded base 2. A generally L-shaped intermediate arc runner 29 is disposed to connect the arc horns 9 and 25 and the arc extinguishing grids 27 and 27' thereby intensifying the arc blowing magnetic flux. The arc extinguishing grid 27 disposed horizontally between the arc horn 25 and one side of the intermediate arc runner 29 is formed by arranging a plurality of arc extinguishing plates 28, which, as shown in FIG. 7, have a slanted V-shaped notch 28*a* for drawing the arc therein, in parallel, spaced, stacked relationship with the V-shaped notches 28*a* slanted into alternating directions. The arc extinguishing grid 27', disposed in a slanted position between the arc horn 9 and the other side of the intermediate arc runner 29 and directed toward the bottom wall of the mold base 2, is formed by arranging a plurality of arc extinguishing plates 28', which, as shown in FIG. 7, have a notch 28'*a* on the side of the contacts for drawing an electric arc therein and another notch 28'*b* on the lower edge of the plate, in parallel, equally spaced stacked relationship with a longer leg 28'*c* and a shorter leg 28'*d* of the arc extinguishing plate 28' located on alternating sides. The arc extinguishing plates 28, 28' may be formed of any magnetic material, nonmagnetic material or electrically insulating material. If desired, some of the plates 28, 28' of the arc extinguishing grids 27, 27' may be formed of a magnetic material to utilize them as a part of a magnetic flux path formed in the magnetic core means 14. A buffer plate 30 made of an electrically insulating material is disposed in the arc extinguishing chamber 26 at the exit end of the arc extinguishing grid 27 to define an expansion chamber 31 within the housing 1. Thus, the arced gas exhausted from the arc extinguishing grids 27, 27' passes through the vent holes 30*a* in the buffer plate 30 into the exhaust expansion chamber 31 located at the bottom of the molded base 2, from where the arced gas is exhausted to the exterior of the housing through an exhaust port 32 (FIGS. 2 and 6) formed in the mold base 2 between the terminals 6'.

In the illustrated preferred embodiment of the present invention, a bimetallic element 34 is used as the tripping element of the time limiting trip device 33 in the overcurrent responsive means 18. The bimetallic element 34 is generally J-shaped as seen in FIGS. 4 and 7 and has formed therein a central slit 35 which extends from the shorter leg of the "J" over the substantial portion of the length of the longer leg of the "J" with the free end of the longer leg not being split. The split free ends 34*b*, 34*c* of the shorter leg of the bimetallic element 34 are electrically connected to the lead conductors 16*a*, 16*b* of the secondary coil 16. The bimetallic element 34 is secured at its bight portion to the bottom wall of the trip element chamber 2*c* by means of a set screw 37 extending through a hollow cylindrical projection 2*d* on the molded base 2, the insulation 36 and an enlarged portion of the slit 35 in the bight portion 34*d* of the bimetallic element 34. A bimetal adjusting screw 38 is mounted on the upper connection portion 34*a* of the bimetallic element 34 so as to engage the tongue 39*a* of a trip bar 39.

Figure 11:
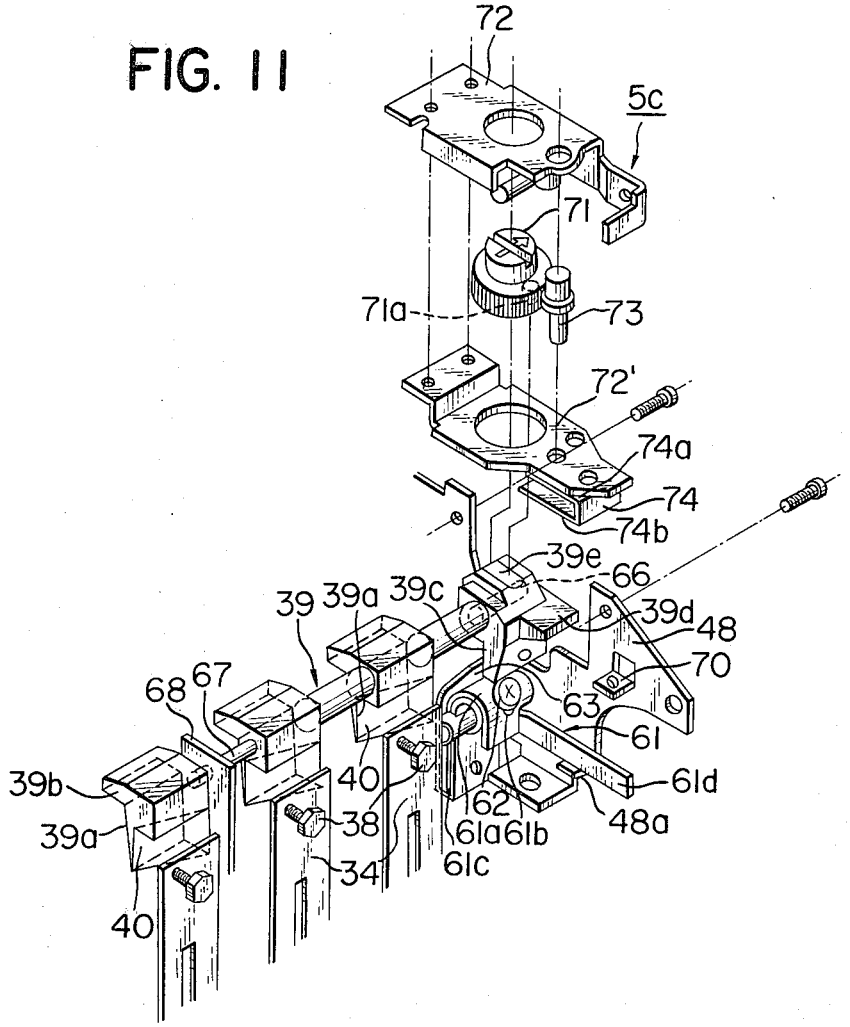
FIG. 11 is an exploded perspective view of the rated current adjustment mechanism.

The trip bar 39 is made of a molded insulating material and extends from the operating mechanism compartment 5 over the pole units through the side partition walls of the interrupter at about the junction between the molded base 2 and the molded cover 3 of the housing 1. The tongues 39*a* for the respective poles each has an inclined surface 40 on the face facing the adjusting screw 38 of the bimetallic element 34 so as to enable the clearance between the adjusting screw 38 and the tongue 39*a* to be adjusted by moving the trip bar 39, which is axially movably supported in the housing 1, in the axial direction. The axial movement of the trip bar 39 is effected by a rated current adjusting mechanism 5*c* (FIG. 11) which will be described later. A conductor piece 7′*a* on one side of a terminal conductor plate 7′ is electrically connected to a lead conductor 15*b* of the primary coil 15, and the other side of the terminal conductor plate 7′ is electrically connected through a conductor piece 7′*b* extending through the end wall of the molded base 2 to the terminal 6′ for electrical connection to an external circuit to be protected.

The instantaneous trip mechanism 41 of the overcurrent responsive means 18 includes an instantaneous tripping armature 42 which is pivotably supported at lugs 42*a* on the magnetic yokes 20 by means of a pivot pin 44 extending through the magnetic yokes 20 and a frame 43 disposed between the yokes 20. The armature 42 has at its one end an enlarged portion 42*b* capable of bridging the edges of the magnetic yokes 20, the other end 42*c* of the armature 42 extends to the location where it is engageable with a projection 39*b* of the trip bar 39. A leaf spring 45 attached at one end to the armature 42 biases the enlarged portion 42*b* of the armature in the direction away from the pair of magnetic yokes 20. The frame 43 has mounted thereon an instantaneous tripping adjusting screw 46 which engages the free end of the leaf spring 45. The rotation of the adjusting screw 46 by a suitable tool such as a screw driver through an access port after a cover 3′ is removed causes the amount of deflection of the leaf spring 45 to vary, thereby adjusting the instantaneous trip set value to a desired value. The frame 43 is provided with a stopper 43*a* for limiting the movement of the armature 42.

Figure 8:
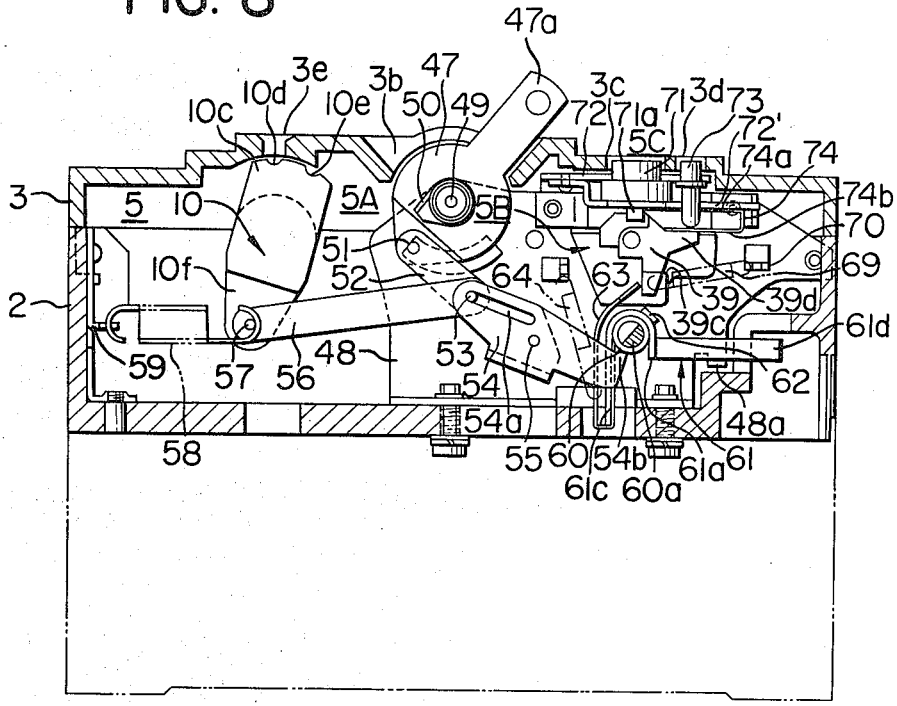
FIG. 8 is a sectional view of the operating mechanism taken along the line VIII—VIII of FIG. 1 illustrating the circuit interrupter in its off or reset position.
Figure 9:
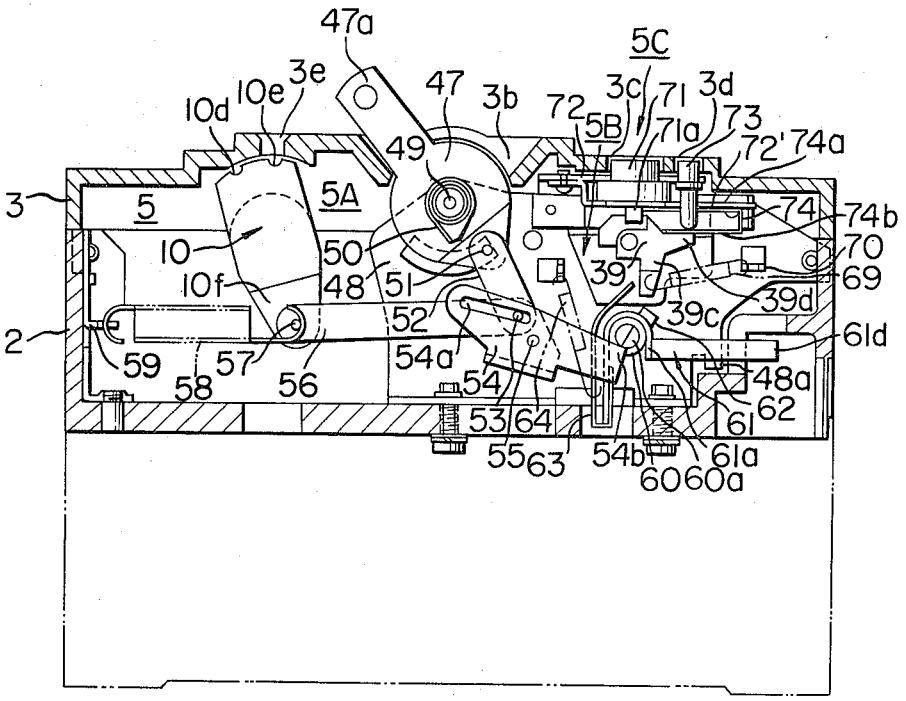
FIG. 9 is a view similar to FIG. 8 but illustrating the circuit interrupter in its on position.
Figure 10:
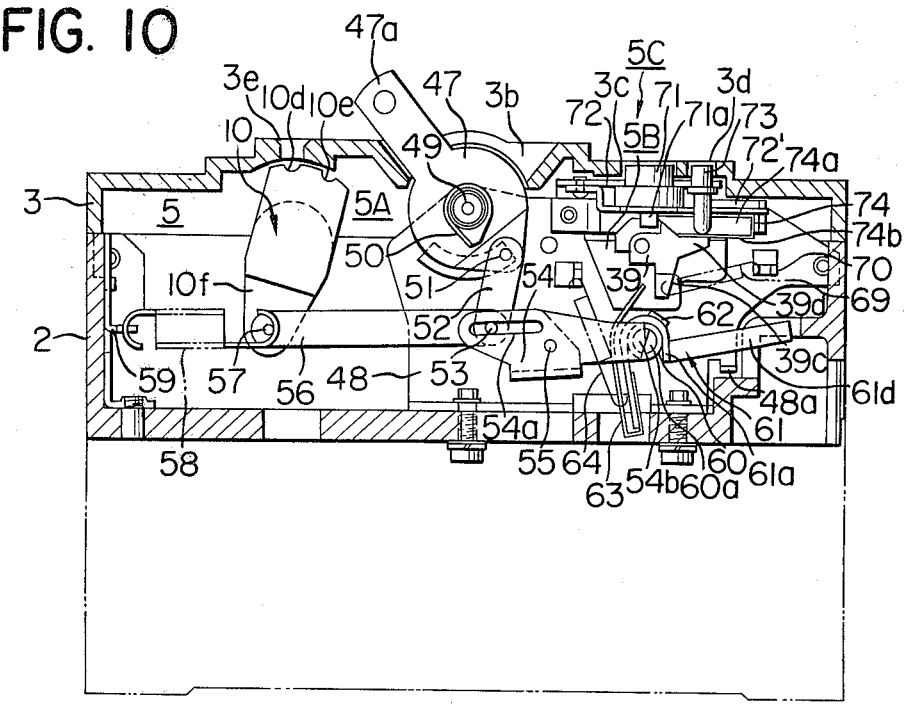
FIG. 10 is a view similar to FIG. 8 but illustrating the circuit interrupter in a position in the process of instantaneous tripping.

In the operating mechanism compartment 5, there are provided as shown in FIGS. 8 to 12 the operating mechanism 5A and the trip mechanism 5B in connection with the contact cross bar 10 and the trip bar 39, thereby enabling the ordinary opening and closing operation and an automatic tripping operation due to overcurrent tripping. The operating mechanism 5A comprises a handle 47 of a molded insulating material supported by a handle shaft 49 on a pair of frame members 48 secured on the molded base 2. A knob portion 47*a* of the handle 47 extends from an opening 3*b* in the molded cover 3 so as to enable the handle 47 to be manually rotated. In FIGS. 8 to 10, when the knob 47*a* of the handle 47 is on the left side in the Figures the circuit interrupter is in the on position, and when the knob 47*a* is on the right side it is in the off position. A torsion spring or a handle spring 50 is disposed between the frame members 48 and the handle 47 to biase the handle 47 in the off direction or in the clockwise direction. Connected to the handle 47 by a pin 51 is one end of an operating link 52, and the other end of the link 52 is loosely connected to a trip lever 54 by means of a pin 53 and an elongated slot 54*a*. The trip lever 54 is pivotably supported by a trip lever shaft 55 secured to the frame members 48. A contact link 56 is connected at its one end to the operating link 52 by means of the pin 53 engaging the elongated slot 54*a* in the trip lever 54, and at the other end to cross bar actuating members 10*f* integrally formed on the contact cross bar 10, by a pin 57. The pin 57 on said other end of the contact link 56 is engaged by one end of an operating spring 58, the other end of which is connected to a spring holding member 59 secured on the molded base 2. Thus, the operating spring 58 always biases the contact cross bar 10 to rotate in the clockwise direction.

Figure 5:
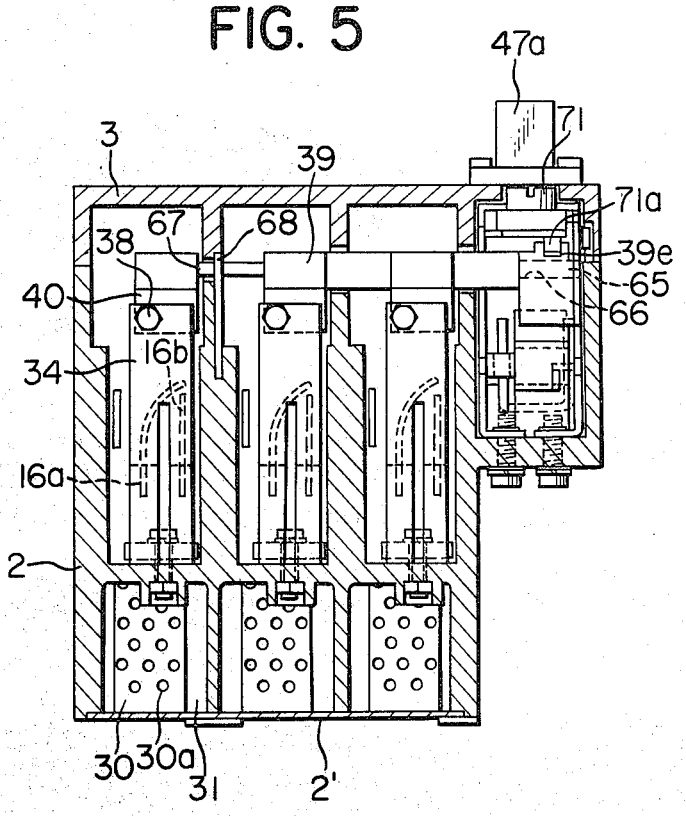
FIG. 5 is a sectional view taken along the line V—V of FIG. 1.

In the trip mechanism 5B, a latch portion 54*b* on the one end of the trip lever 54 engages a latch 60*a* of a semicircular cross section formed on a trip pin 60 rotatably supported from the frame member 48 in the usual circuit open and closed position of the circuit interrupter. The trip pin 60 has a trip pin arm 61 which is secured on the trip pin 60 by means of an elongated hole 61*b* in a portion 61*a* circularly bent along the circumference of the trip pin 60 and a screw 62 inserted into a tapped hole in the trip pin through the elongated hole 61*b*. This arrangement allows the adjustment of the amount of engagement of the latch portion 54*b* of the trip lever 54 with respect to the latch 60*a* of the trip pin 60 by loosening the screw 62 and sliding the trip pin arm 61 on the trip pin 60. One end, 61*c*, of the trip pin arm 61 adjustably secured on the trip pin 60 is connected to one end of an ambient temperature compensating bimetal 63, the other end of the bimetal 63 extending so as to be engageable by the projection 39*c* of the trip bar 39. A trip pin return spring 64 biases the trip pin arm 61 in the clockwise direction. The clockwise movement of the trip pin arm 61 is restricted by the engagement of an extended engagement projection 61*d* on the other side of the trip pin arm 61 with a stopper 48*a* formed on the frame members 48, thereby determining the rest position of the trip pin arm 61 in terms of its clockwise rotational movement. As seen in FIG. 5, one end of the trip bar 39 is rotatably and axially slidably supported on a support pin 65 secured on the side wall of the molded base 2 of the operating mechanism compartment 5 and with its bore extending along the axis of the trip bar 39 engaged on the support pin, and the other end of the trip bar 39 is rotatably and axially slidably supported at its metallic shaft 67 integrally molded in the trip bar 39, by a bearing plate 68 attached on the partition wall between the outermost pole unit compartment 4 and the central compartment. A trip bar spring 69 connected between the projection 39*c* of the trip bar 39 and a spring support 70 of the frame member 48 biases the trip bar 39 in the clockwise direction.

The circuit interrupter also comprises the rated current adjusting mechanism 5*c* shown in FIGS. 8 to 11 which includes a rated current adjusting knob 71 made of a molded insulating material and rotatably supported by a bracket 72 secured to the frame member 48. The adjusting knob 71 has a head portion exposed through an opening 3*c* formed in the molded cover 3, and its lower end has an eccentric projection 71*a*. The eccentric projection 71*a* extends into a groove 39*e* formed in the trip bar 39 so that the rotation of the rated current adjusting knob 71 causes movement of the projection 71*a* in an arcuated path, which movement then moves the trip bar 39 in the axial direction. This axial sliding movement of the trip bar 39 changes the position of the inclined surface 40 of the tongues 39*a* with respect to the bimetal adjusting screw 38 in each of the pole units to change the clearance between the adjusting screw 38 and the inclined surface 40, thereby enabling the adjustment of the set current value. A trip push buttom 73 is disposed so that its head is exposed at an opening 3*d* formed in the molded cover 3 as in the case of the rated current adjusting knob 71, and its lower end extends through the bracket 72, 72' and the upper side 74*a* of the U-shaped trip push button return spring 74 attached to the bottom surface of the bracket 72' until it engages the lower side 74*b* of the U-shaped trip push button return spring 74. The lower end of the push button 73 is capable of pushing a projection 39*d* of the trip bar 39 against the action of the return spring 73.

As shown in FIGS. 3, 8, 12*a* and 12*b*, the cross bar 10 has formed thereon an operation display member 10*c* on the opposite side of the cross bar operating member 10*f*. The display member 10*c* has two grooves 10*d* and 10*e* in its peripheral surface, and one of the grooves 10*d* for example may be painted in green and the other groove 10*e* may be painted in red, thereby enabling a visible display of the position of the circuit interrupter by exposing the red groove 10*e* through the display window 3*e* when the circuit interrupter is in the closed position and the green groove 10*d* when the interrupter is in the open position.

Figure 13:
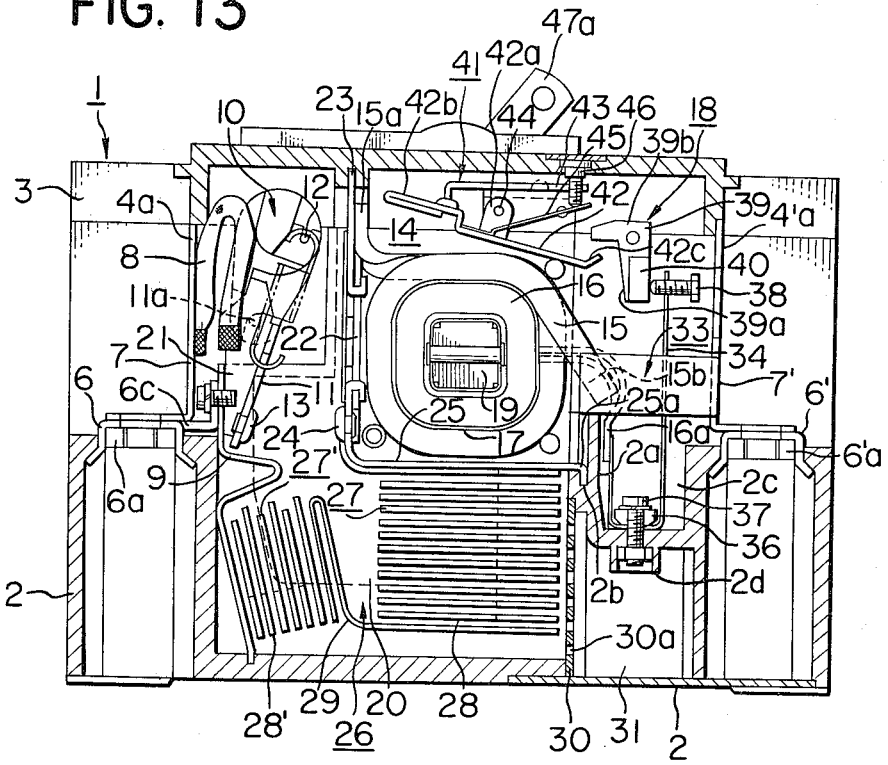
FIG. 13 is a sectional view similar to FIG. 4 but illustrating the circuit interrupter in its off position.

When the circuit interrupter is in the usual off position illustrated in FIGS. 8 and 13, the operating knob 47*a* of the handle 47 is tilted to the right in the Figures and the latch portion 54*b* of the trip lever 54 is engageable with the latch 60*a* of the trip pin 60, the circuit interrupter being in the position prepared for the closing operation. When the operating knob 47*a* is moved leftward into the on side from the above off position, the pin 53 is moved through the operating link 52 within the elongated slot 54*a* of the trip lever 54 in the right direction, whereby the contact cross bar 10 is rotated in the counterclockwise direction by means of the contact link 56. Then the operating spring 58 is expanded to increase its tension, and during the final closing movement, a line connecting the centers of the handle shaft 49, the pin 51 and the pin 53 is brought into the over center link state as shown in FIG. 9, and the handle 47 and the operating link 52 are held in this position. Therefore, the contact cross bar 10 is brought into the on position shown in FIG. 4 wherein the movable contact 13 on the movable contact arm 11 is pressure engaged with the stationary contact 24. The manual clockwise rotation of the operating know 47*a* from this on position moves the pin 53 through the operating link 52 into the left within the elongated slot 54*a* of the trip lever 54 to rotate the contact cross bar 10 in the clockwise direction through the contact link 56, whereby the contact cross bar 10 separates the movable contact 13 from the stationary contact 24.

In the automatic interrupting operation due to the actuation of the overcurrent trip means in response to an overcurrent, the trip bar 39 is rotated in the clockwsie direction by the bimetallic element 34 of the overcurrent responsive mechanism 18, and the projection 39*c* of the trip bar 39 causes the ambient temperature compensating bimetal 63, the trip pin arm 61 and the trip pin 60 to rotate in one body in the counterclockwise direction. This movement releases the latch 54*b* of the trip lever 54 from the latch portion 60*a* of the trip pin 60 to permit the trip lever 54 to rotate in the counterclockwise direction, thereby allowing the pin 53 on the contact link 56 to be moved to the left within the elongated slot 54*a* of the trip lever 54 by the action of the operating spring 58. The operating spring 58 also rotates the contact cross bar 10 in the clockwise direction to separate the movable contact 13 from the stationary contact 24 to interrupt the current (FIG. 10). During this movement, since the handle spring 50 is rotated in the clockwise direction together with the handle 47, the operating link 52, the trip lever 54 and the contact link 56 are pulled upward, thereby, passing through the position shown in FIG. 10, returning by the handle spring 50 the latch portion 54*b* of the trip lever 54 to the off position wherein it is engaged by the latch 60*a* of the trip pin 60.

Figure 14:
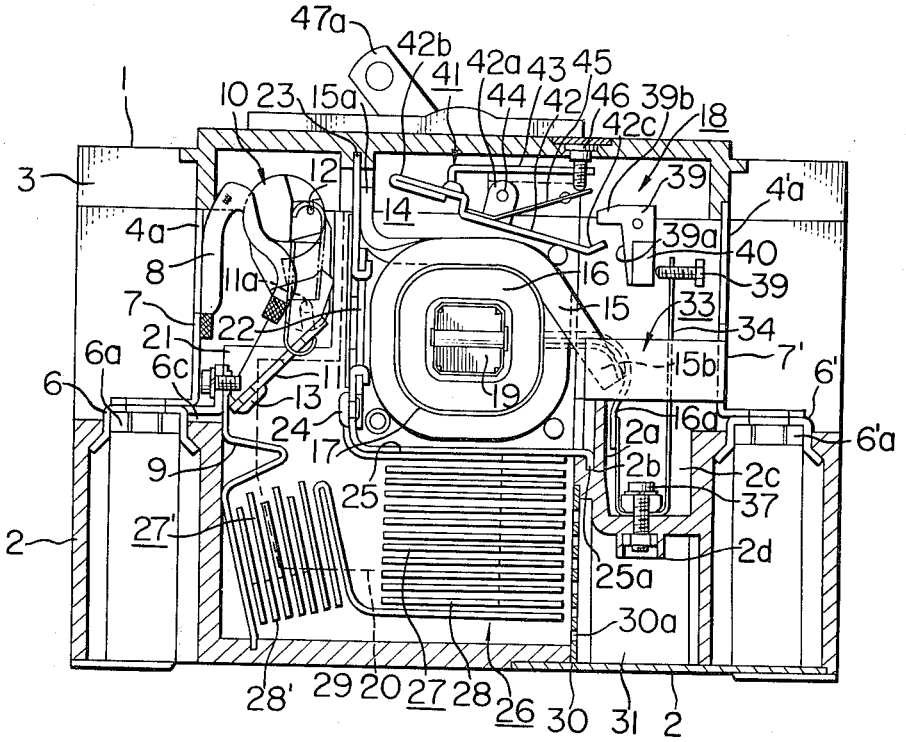
FIG. 14 is a sectional view similar to FIG. 4 but illustrating the interrupter in a position in the process of short-circuit interruption.

Upon the occurrence of a very high overcurrent such as a short-circuit current, the primary coil 15 connected to the contact arm 23 so as to flow the current in the same direction generates an electromagnetic field which crosses the movable contact arm 11 to exert an electromagnetic force on the movable contact arm 11. Then the movable contact arm 11 is rotated in the clockwise direction about the projections 11*a* supported on the contact holder member 10*a* against the action of the contact spring 12 while the cross bar 10 is maintained in the closed position. This rotation of the movable contact arm 11 causes the movable contact 13 to quickly separate from the stationary contact 24 to interrupt the current, and the rotated movable contact arm 11 is held in the position shown in FIG. 14 by the over centered spring function of the contact spring 12. After this operation, the overcurrent responsive mechanism 18 is actuated to rotate the trip bar 30, and as previously described, the latch 60*a* of the trip pin 60 releases the latch 54*a* of the trip lever 54 to collapse the operating mechanism and rotate the contact cross bar 10 in the clockwise direction. This movement causes the movement of the projections 11*a* of the movable contact arm 11 to the opposite side of the line of action of the contact spring 12, thereby returning the movable contact arm 11 to the normal position with respect to the contact holder member 10*a*, as shown in FIGS. 8 and 13 wherein the latch 54*b* of the trip lever 54 is in engagement with the latch portion 6*a* of the trip pin 60 because of the action of the handle spring 50, and the circuit interrupter is in the off position.

In the circuit interrupter as above described, the electromagnetic device 14, which is the main component of the present invention, comprises the circuit current carrying primary coil 15, which can be selected so that the number of ampere-turns is substantially the same irrespective of the magnitude of the rated current. Therefore, the circuit interrupter of the present invention can be designed to have a very small rated current. For the practical electric motor protective circuit interrupter, the minimum rated current may be about 1 A.

The secondary coil 16 is selected so as to provide a substantially equal secondary current with respect to the respective rated currents. Therefore the current with which the overcurrent responsive device 18 connected to the secondary coil 16 is actuated can be the same irrespective of the rated current of the interrupter.

Since the secondary current can be set to be equal in each interrupter irrespective of the rated current values of the respective interrupters, it is easy to minimize and to maintain at the same value the electric energy supplied upon overcurrent tripping when the overcurrent responsive device 18 is of the bimetallic thermal responsive type.

For example, by using the same bimetallic element 34 in different circuit interrupters and by limiting the heat generation by the bimetal to the same minimum value irrespective of the rated current of the interrupter, the bimetallic element for the time delay tripping does not have to have a high resistance value even with a very low rated current, eliminating the need for replacing the bimetal in terms of the resistance, bending coefficient, width and thickness of the bimetal element according to the rated current and eliminating the possibility of varying electric power being required to actuate the bimetallic element according to the rated current, which problems are present in the conventional arrangement in which the primary current directly flows through the bimetallic element.

In the preferred embodiment of the present invention, the current through the bimetallic element is selected to be about 5 A by calculating the ratio of the numbers of turns. Although this value of the secondary current is close to the minimum value of the actuating current for the directly heated bimetal of a simple construction, a circuit interrupter with this secondary current can be designed by decreasing as low as possible the mechanical tripping force and trip stroke. Therefore, when the rated value of the primary current is less than 5 A, the secondary current is stepped up and when the primary current is over 5 A the secondary current is stepped down by properly selecting the ratio of the numbers of turns. By this measure, it is possible to use the bimetallic trip arrangement even with a very small primary current of less than 5 A, and a time limiting trip bimetallic element of the same structure can be used irrespective of the rated current of the circuit interrupter to obtain the same tripping time characteristics.

Since the bimetallic element 34 of the overcurrent responsive device 33 is connected to the secondary coil of the current transformer of the electromagnetic device 14, the current through the bimetallic element 34 does not rise beyond a certain level no matter how high the short circuit current through the primary coil 15 is due to the magnetic saturation of the electromagnetic device 14. Therefore the bimetallic element 34 is protected from being burnt out by the short circuit current, eliminating one of the problems in the increase of the interruption current. Since the electromagnetic device 14 is arranged as a special open core type in order to provide it with the functions of contact arm electromagnetic drive and arc drive in addition to the above described current transformation function, it is ordinarily difficult to efficiently transform the primary current into the secondary current and to arrange it so that the secondary current is maintained at a value transformed by a predetermined factor with respect to the differently rated primary current. However, the electromagnetic device 14 has been improved in the above respect to the extent that the device is used in practical interrupters by limiting the stray flux from the primary coil to a minimum and by making the flux effectively cross the secondary coil 16. That is, the stray flux has been reduced by coaxially winding the primary coil 15 and the secondary coil 16. Preferably, the primary coil 15 is wound outside of the secondary coil 16. This arrangement causes the conductor length and the resistance of the primary coil to increase, but this resistance functions as an impedance directly connected to the main circuit and provides the current limiting function which is desirable upon short circuit. This effect is significant with a very small rated current such as a rated current of several amperes. Also, the conductor length of the secondary coil 16 is relatively short, providing a relatively small resistance, so that the load to current transformer is small.

The magnetic core structure of the electromagnetic device 14 is composed of a pair of right and left magnetic yokes 20 and a single magnetic core 19 connecting the magnetic yokes 20 and defines a magnetic flux path around the magnetic core, the magnetic yokes 20 extending over the contact portions 20*a*. Therefore, when an excessive current such as a short circuit current flows through the magnetic device 14, the magnetic field generated by the primary coil 15 which is connected so as to flow the current in the same direction as that in the stationary contact arm 23, crosses the movable contact arm 11 to generate an electromagnetic force which rotates the movable contact lever 11 in the clockwise direction about the pivot 11*a* with respect to the contact holder member 10*a* against the action of the contact spring 12 while maintaining the contact cross bar 10 in the closed position, thereby directly separating the movable contact 13 from the stationary contact 24 to generate an electric arc therebetween and effect the current limiting interruption at the initial stage of the short circuit current. Since even with the highest rated current circuit interrupter of the same structure the primary coil has a few turns, the electromagnetic force in the direction of the separation of the movable contact arm 11 is increased compared to the current limiting breakers of the conventional design, and since the primary coil 15 is wound so as to provide the same ampere-turns with respect to the rated current, the number of turns is larger and the electromagnetic force acting upon the movable contact arm 11 to separate it due to the same overcurrent is larger with the smaller rated current, thus the electric arc is initiated at a lower rated current as the rated current decreases and the total interruption $I^2t$ can be made smaller. Therefore, the arcing and the current limiting are initiated more quickly than in the conventional current limiting breaker, and particularly when the rated current is small the number of turns of the primary coil 15 is large, significantly quickening the initiation of the current limiting. Also, when the primary coil 15 is wound around the secondary coil 16, the primary coil 15 is partly in the vicinity of the movable contact arm 11, thus increasing the electromagnetic driving force of the electromagnetic device 14 on the movable contact arm 11.

The electromagnetic yokes 20 of the magnetic core means of the electromagnetic device 14 are extended and enlarged to form the contact portion 20*a* and the arc extinguisher portion 20*b*, so that the electric arc established between the separated contacts is elongated by a massive driving force due to the magnetic field in the magnetic gap. Since the direction of the magnetic field is substantially perpendicular to the pair of right and left magnetic yokes 20, the direction of movement of the electric arc is always at right angles away from the direction of the current flow. Therefore, the arc is forced into the slit or notches formed in the arc extinguishing grids 27 to be divided, cooled and extinguished. Thus, this arrangement provides an effective electric arc driving means.

In addition, the magnetic yokes 20 of the electromagnetic device 14 define the instantaneous tripping portion 20*c*, in the vicinity of which the movable armature 42 of the instantaneous trip mechanism is disposed to oppose a portion of the outer periphery of the magnetic yokes 20, so that the armature 42 is magnetically operable by the primary current to rotate the trip bar 39 and collapse the operating mechanism 5 A, thereby simultaneously separating the movable contacts from the stationary contacts in all of the pole units. The magnetic attractive force exerted upon the movable armature is the same in terms of the load factor even with differently rated currents since the primary coil 15 is arranged to have substantially the same number of ampere-turns irrespective of the different rated current. Therefore, the instantaneous tripping value can be set to substantially the same desirable value under any circumstances. This arrangement makes it possible to select the instantaneous tripping value when the total load current is 1 A for example at 12 times to 15 times the total load current, which has been impossible according to the prior art.

As has been described, the present invention utilizes a single multi function electromagnetic device provided with a current transformer means, an electromagnetic driving means for driving a movable contact arm, an electric arc driving means for driving an arc into an arc extinguisher, and an instantaneous tripping means. Therefore, the circuit interrupter of the present invention is compact in size and inexpensive, while providing various advantageous effects for achieving the previously mentioned objects.

What is claimed is:

1. A circuit interrupter comprising in an insulating housing:

an electromagnetic means including a magnetic core, at least two separate magnetic yokes magnetically coupled to said magnetic core and defining a magnetic gap therebetween, and a primary and a secondary coil wound on said magnetic core, said electromagnetic means forming a current transformer;

a pair of separable contacts connected in series with said primary coil, one of said contacts being carried by a movable contact arm extending within said magnetic gap in a direction enabling electromagnetic separation by an overcurrent, and said contacts and said primary coil being connectable to an external circuit to be protected;

an operating mechanism for opening and closing said separable contacts;

a thermally responsive trip means including a bimetal element serially connected to said secondary coil of said electromagnetic means for actuating said operating mechanism to open said contacts upon the occurrence of an overcurrent;

an instantaneous trip means including a magnetic armature disposed in the vicinity of said electromagnetic means for magnetically actuating said operating mechanism to separate said contacts upon the occurrence of a short-circuit current;

an arc extinguishing means disposed within said magnetic gap of said electromagnetic means for extinguishing an electric arc; and means including portions of said magnetic yokes of said electromagnetic means for magnetically driving an electric arc established between separated contacts into said arc extinguishing means.

2. A circuit interrupter as claimed in claim 1, wherein said magnetic yokes are two parallel magnetic plates magnetically coupled to each end of said magnetic core so as to provide a substantially annular magnetic gap around said magnetic core, said primary and secondary coils are disposed in said annular magnetic gap, and said contacts, said contact arm and said arc extinguishing means are disposed directly outside of said coils in said magnetic gap.

3. A multi-pole circuit interrupter, comprising:

a pair of movable and stationary contact arms for each pole each having at its one end a contact;

a contact cross bar carrying said movable contact arm in common to all the poles and movable between contact closing and opening positions;

a contact spring means for providing a contacting pressure between the contacts in the closed position;

an operating mechanism for unitarily operating said movable contact arm and said contact cross bar;

a trip mechanism for causing said operating mechanism to collapse in response to a trip command irrespective of its position;

a time limiting trip bimetal element operable in response to an overcurrent to actuate said trip mechanism;

arc extinguishing means for extinguishing an electric arc established between separated contacts;

an insulating casing enclosing at least live portions of the interrupter less terminals for the external connection and having therein an arc exhaust port;

an electromagnetic means including a magnetic core, at least two separate magnetic yokes each extending from said magnetic core to provide a magnetic gap therebetween, and a primary and a secondary coil, said primary coil being wound around said magnetic core and electrically serially connected to said contact to flow a primary current therethrough and said secondary coil being wound around said magnetic core in an inductive relationship with said primary coil and electrically serially connected to said bimetal element to cause a secondary current to flow in said bimetal element, thereby forming a current transformer;

means, including portions of said electromagnetic means and the movable contact arm disposed in said magnetic gap, for driving said movable contact arm into the contact open position due to an electromagnetic force exerted on said contact arm by the magnetic flux generated in said magnetic gap upon the occurrence of a short-circuit current;

means including portions of said magnetic core means for magnetically driving an electric arc established between separated contacts by a magnetic field formed within said magnetic gap; and an instantaneous trip means including a magnetic armature disposed in said magnetic gap and capable of being magnetically actuated by a magnetic field in said magnetic gap upon the occurrence of a predetermined overcurrent to provide the trip command to said trip mechanism.

* * * * *